United States Patent [19]

Tarlton, Jr.

[11] 4,028,760

[45] June 14, 1977

[54] DOUBLE SLALOM SKI

[76] Inventor: Russell W. Tarlton, Jr., 1109 Athens Drive, Raleigh, N.C. 27606

[22] Filed: Aug. 25, 1975

[21] Appl. No.: 607,471

[52] U.S. Cl. ..... 9/310 A; 9/310 AA; 280/607

[51] Int. Cl.[2] ..... A63C 5/00

[58] Field of Search ..... 9/310 R, 310 A, 310 AA, 9/310 E, 310 B; 280/607

[56] References Cited

UNITED STATES PATENTS

| | | | |
|---|---|---|---|
| 3,173,161 | 3/1965 | Amsbry | 9/310 A |
| 3,201,807 | 8/1975 | Weaver | 9/310 A |
| 3,571,832 | 3/1971 | Rauch | 9/310 B |
| 3,626,529 | 12/1971 | Schreck | 9/310 A |

*Primary Examiner*—Trygve M. Blix
*Assistant Examiner*—Sherman D. Basinger
*Attorney, Agent, or Firm*—Mills & Coats

[57] ABSTRACT

In abstract a preferred embodiment of this invention is a slalom type water ski designed for use by at least two skiers at the same time. A pair of laterally disposed binders are provided next to each other in the central portion of the ski with a lead foot binder for one skier being provided forward of the central binders and another binder being provided rearwardly thereof for the trailing foot of the second skier.

9 Claims, 7 Drawing Figures

DOUBLE SLALOM SKI

This invention relates to aquatic devices and more particularly to slalom type water skis.

Over the years, the sport of water skiing has developed to the point where it is presently enjoyed by millions of people annually. At first, two skis were used as is the practice with snow skiing. The better skiers begin to kick off one ski and ride on the remaining one, and this practice has developed into what is known as the slalom ski. In the past few years, slalom skiing has become a wide spread sport, and today is probably used more than the double skis of the past.

The one disadvantage of the slalom ski as well as the standard double skis is that, although two or more people can be pulled independently by the towing craft or boat, the skiing itself is, unlike snow tobogganing, water tobogganing and water sleding, an individual sport.

Being an individual sport, each individual has to learn how to water ski himself with only prior oral instructions from others. Also, the skier of minimum experience cannot enjoy the pleasures and thrills of expertly executed maneuvers that can be performed only by expert skiers.

Although dual water sleds such as that shown in U.S. Pat. No. 3,082,433 have been known, the idea of two or more persons riding on a single ski with the control and maneuverability of such a conveyance has been heretofore thought impossible. Even trick ski exhibitions such as Florida's Cypress Gardens have not developed the single ski, multi-skier concept.

After much research and study into the above mentioned problems, the present invention has been developed to provide a single ski for use by two or more skiers simultaneously. The design of this ski is simple and yet highly efficient for the purpose and has been adequately demonstrated in actual use to show not only that it is possible, but additionally that it is a highly practical aquatic device.

In view of the above, it is an object of the present invention to provide an improved slalom type water ski for use by two or more skiers simultaneously.

Another object of the present invention is to provide an improved slalom ski for use by two or more skiers which is well balanced for ease of use.

Another object of the present invention is to provide a dual slalom ski with foot straps so arranged that either a right foot forward or left foot forward stance can be used by the skiers.

A further object of the present invention is to provide a foot strap arrangement for a dual slalom ski wherein a forward shoe is provided, a pair of side-by-side shoe straps aft of the shoe, and two additional longitudinally aligned straps aft of said pair of straps whereby a choice of lead foot is given to the users of the ski.

An even further object of the present invention is to provide an improved keel for use with a dual slalom ski, said keel being in the form of a generally semi-circular shape with openings provided along the periphery thereof.

Another object of the present invention is to provide, in an improved water ski, a concave-in-cross-section slot extending longitudinally from a point near the forward portion of the ski to the aft part thereof.

Another object of the present invention is to provide a slalom type ski for two or more skiers which requires less power to pull than two skiers on individual slalom skis.

Another object of the present invention is to provide a multi-skier slalom ski which requires only slightly more power to pull than a single skier slalom.

Other objects and advantages of the present invention will become apparent and obvious from a study of the following description and the accompanying drawings which are merely illustrative of such invention. IN THE DRAWINGS.

With further reference to the drawings, the multi-skier, slalom type ski of the present invention, indicated generally at 10, includes an upturned tip or front portion 11, a rear or back portion 12 and a generally flat body portion 13.

Figure 4:
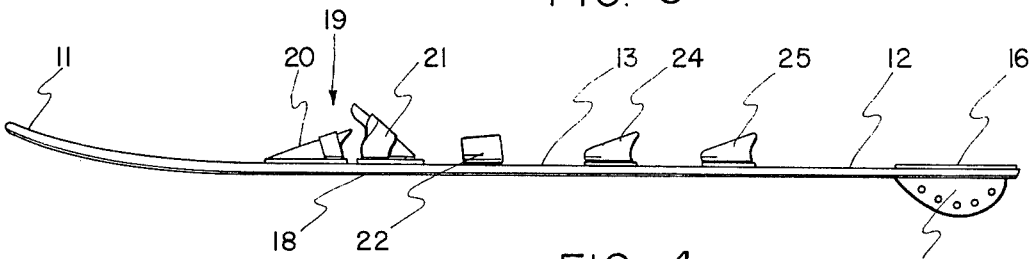
FIG. 4 is a side elevational view of the same.

A generally semi-circular or slightly elliptical ski rudder or keel 14 is secured to the rear portion 12 by means such as screws 15 passing through flange 16 which is secured to said rudder and a plurality of openings are provided along the periphery of rudder 14 as seen clearly in FIG. 4.

Figure 5:
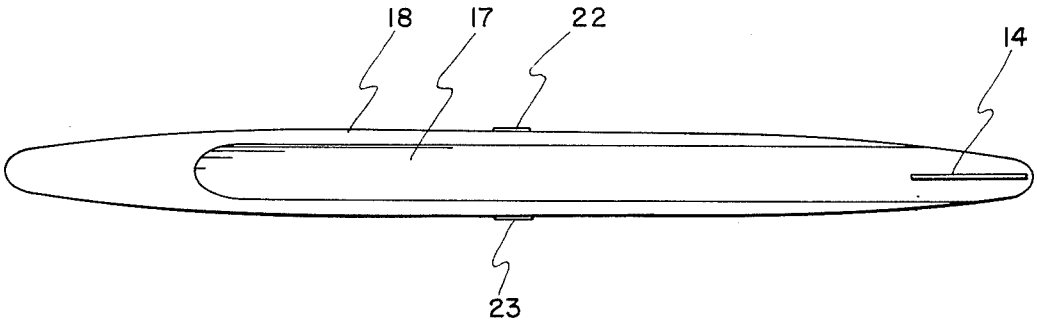
FIG. 5 is a bottom plan view of such ski.
Figure 6:
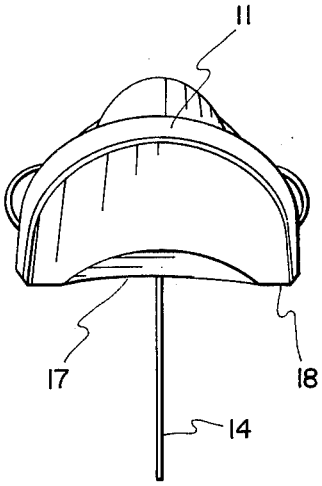
FIG. 6 is a front elevational view of such ski.
Figure 7:
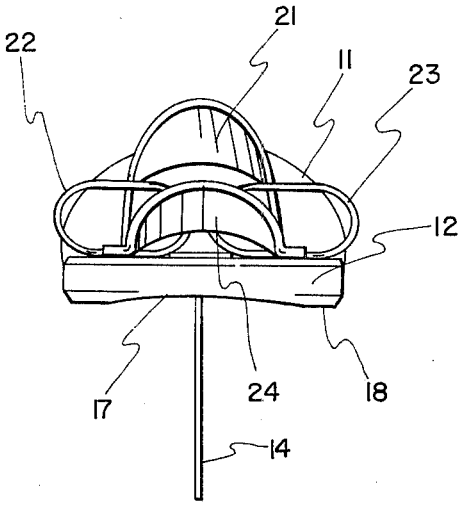
FIG. 7 is a rear perspective view of the same.

The rudder 14, of course, gives lateral stability to the ski 10 when it is being used. Likewise, the longitudinal slot or tunnel 17 in the bottom portion 18 of ski 10 adds lateral stability to such ski. As can be seen particularly clear in FIGS. 6 and 7, the slot 17 is so formed as to be slightly concave when seen in lateral cross section. The slot runs longitudinally along the bottom of the ski as seen in FIG. 5. The rudder or keel 14 is fixedly secured to the rear portion 12 of the ski 10 in the center of slot 17 as, of course, is clearly seen in FIGS. 5 and 7.

A standard ski shoe, indicated generally at 19, includes a fixed toe portion 20 and an adjustable heel portion 21. This is a standard item used on both dual and slalom skis today and further description of the details of the same is not deemed necessary.

Although, other than the lead foot of the lead skier, the foot strap arrangement can vary somewhat, it has been found that a pair of side-by-side or left and right touching foot straps 22 and 23 can be provided just aft of shoe 19. Aft of the pair of straps 22 and 23, in longitudinal alignment therewith, are foot straps 24 and 25 at a comfortable distance from each other.

Although the lead skier 26 could use shoe 19 and either left or right strap 22 or 23 with the second or rear skier 27 using the longitudinally aligned straps 25 and 26, it has been found that a stable and comfortable arrangement is for lead skier 26 to have one foot (as he always will) in shoe 19 and his other or rear foot in strap 24. The rear or second skier 27 will overlap the front or lead skier 26 with his (the rear skier's) lead foot being on the opposite side from the rear foot of lead skier. In other words, if the lead skier 26 has his left foot in strap 24, the rear skier 27 will have his right foot in right strap 23 and, of course, his left foot in rear strap 25. Conversely, if lead skier 26 has his left foot in shoe 19 and his right foot in strap 24, the rear skier 27 would have his left foot as a lead foot in left strap 22 and his right foot in a rear strap 25. In other words, the lead and rear skiers are always in an "in step" position with both using either their right foot or their left foot as the lead foot but never with the right foot of one and the left foot of the other as lead feet.

If it is more comfortable for the skiers, the lead skier 26 can, of course, place his lead foot in shoe 19 and his other foot (whether left or right) in the respective left or right strap 22 or 23 with the lead foot of the rear skier being in the other side-by-side strap with the rearmost foot of the rear skier being placed either in strap 24 or 25.

In summary, other than the lead foot of the lead skier 26 being placed in shoe 19, the foot arrangement of the two skiers is a matter of preference to the individuals concerned.

As indicated above, and as is always true with individual slalom skis, only the lead foot has an adjustable shoe 19 with a heel portion 21.

Water skiers use a tow rope held by the skier himself as distinguished from water sled type devices where the tow rope is secured to the conveyance itself with the rider having some type of relatively fixed handle. Early water skiers used a single handle gripped by both hands of the skier but in recent years the double handle ski rope has been developed where the tow rope is secured to two lead ropes which terminate in a handle for each hand of the skier. The advantage of this arrangement is that when the skier encounters a slacking of pressure the tow rope, he can move his arms outwardly to take up the slack and prevent undesirable deacceleration which may cause him to fall.

Figure 1:
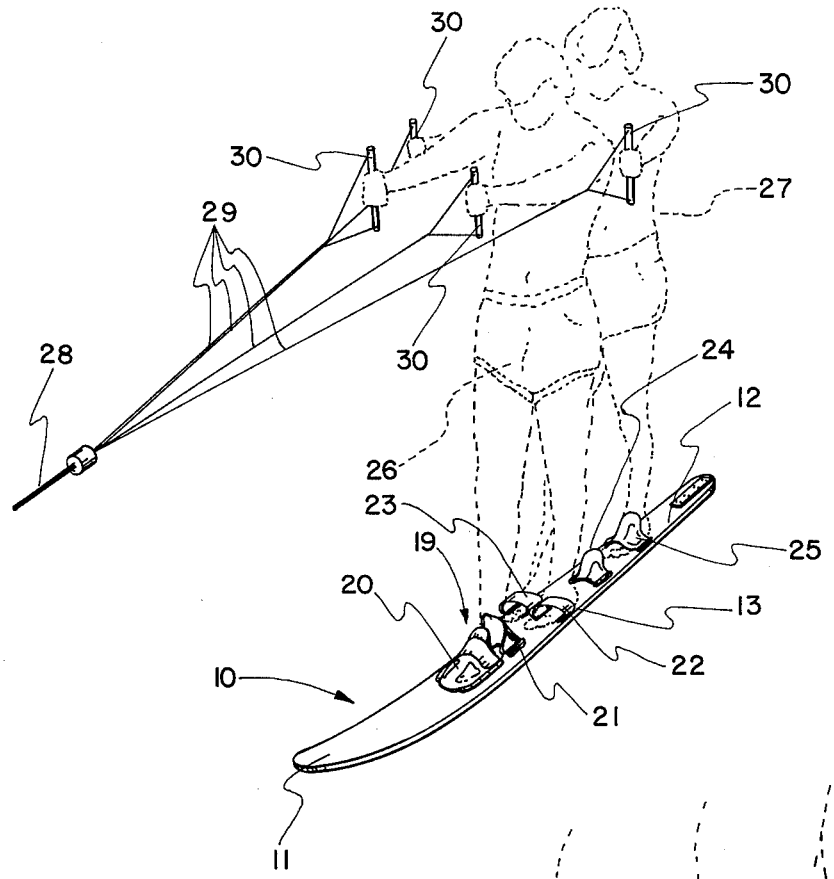
FIG. 1 is a perspective view of the improved slalom ski of the present invention showing two skiers riding thereon.
Figure 2:
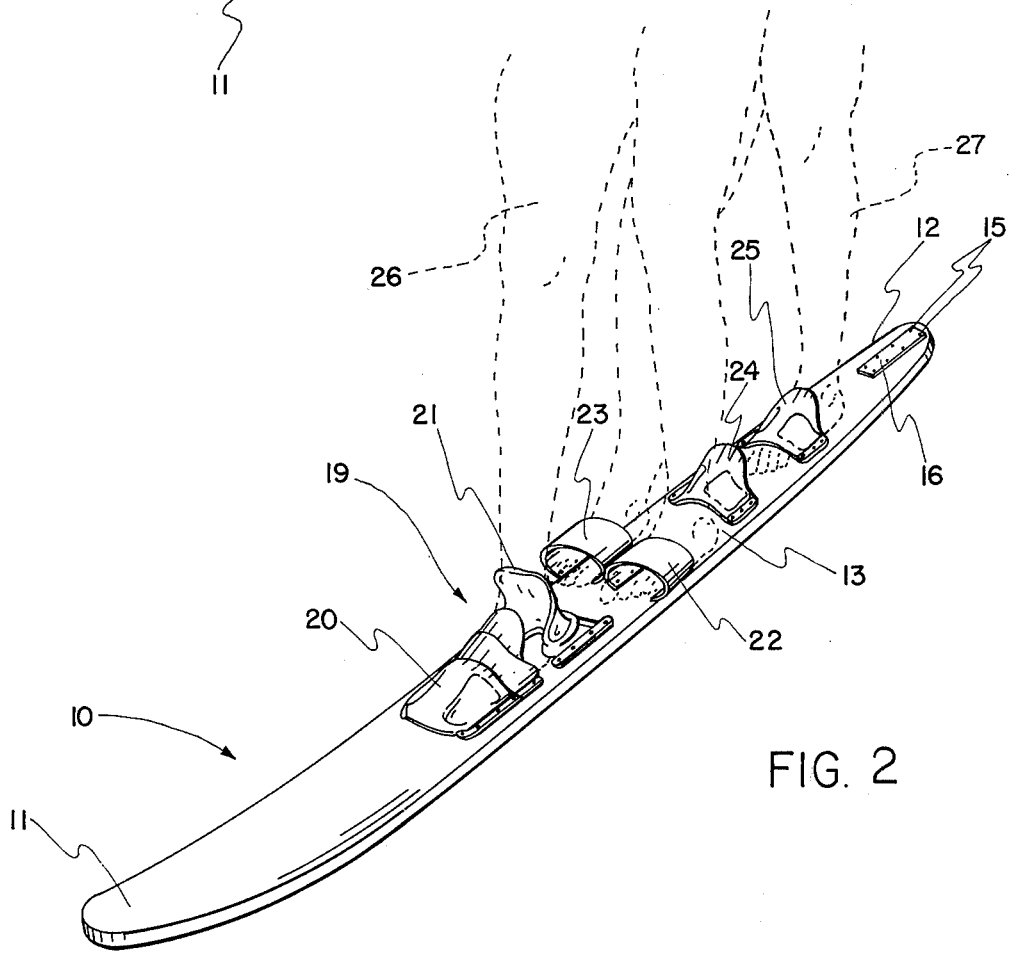
FIG. 2 is an enlarged perspective view of the slalom ski of the present invention.
Figure 3:
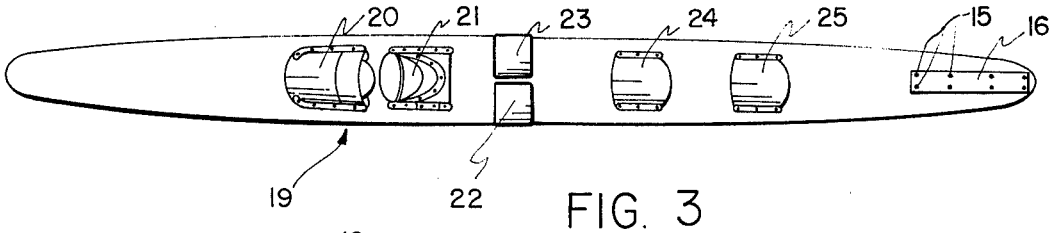
FIG. 3 is a top plan view of the ski of the present invention.

Although either the single handle or double handle ski rope can be used by the lead skier 26 using the slalom ski of the present invention, the split handle is necessary for the rear skier for obvious safety reasons. Tow ropes are usually used by the rear skier 27 when the more spaced apart stance is used as hereinabove described. When the closer stance with overlapping legs is used, the rear skier can either hold onto the waist of the lead skier or can use the split handle shown in FIG. 1.

Although certainly not an inflexible rule, if the rear skier 27 has little or no prior experience, he probably will feel more secure holding onto the waist of the lead skier 26 while if the rear skier is a more experienced skier, he probably would feel more comfortable having his own split handle. As with the foot arrangement, the handle arrangement of the skiers is optional depending on the preferences of the skiers involved.

From the above, it can be seen that the present invention has the advantage of providing a simple, relatively inexpensive and yet highly efficient means for two or more people to participate in the art of water skiing, at the same time, and on the same slalom type ski. The advantages of different possible foot arrangements and towing means gives a versatility that leaves adequate options available for personal preference.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended Claims are intended to be embraced therein.

What is claimed is:

1. A ski device comprising: a slalom type water ski body having a slightly upturned front portion and a relatively flat rear portion; at least four foot retaining means secured to the upper portion of said ski, two of said retaining means being laterally aligned and touching each other with at least one retaining means disposed longitudinally forward thereof and at least one retaining means being disposed longitudinally rearwardly thereof; and means on the bottom portion of said ski to provide lateral directional stability to said ski when in use whereby a slalom type water ski for at least two persons is provided.

2. The ski of claim 1 wherein the means for providing lateral directional stability to said ski is a rudder disposed below the bottom rear portion of said ski.

3. The ski of claim 2 wherein said rudder is a partial ellipse in shape.

4. The ski of claim 3 wherein said rudder is provided with a plurality of openings spaced along the periphery thereof.

5. The ski of claim 1 wherein the means for providing lateral directional stability to said ski is a longitudinal slot provided in the bottom of said ski.

6. The ski of claim 5 wherein said slot extends from a point slightly aft of the upturned front portion longitudinally along the bottom of the ski to said rear portion.

7. The ski of claim 6 wherein said slot is concaved in cross section.

8. The ski of claim 1 wherein the forwardmost foot retaining means is a standard ski shoe whereby directional control of the ski can be maintained.

9. The ski of claim 1 wherein at least five foot retaining means are provided whereby alternate foot arrangements can be provided according to the preference of the skiers.

* * * * *